US010661104B2

(12) United States Patent
Morgan et al.

(10) Patent No.: US 10,661,104 B2
(45) Date of Patent: May 26, 2020

(54) RECONFIGURABLE FULL FACEMASK HAVING A CARTRIDGE MODULE FOR RESPIRATORY PROTECTION

(71) Applicant: Scott Technologies, Inc., Boca Raton, FL (US)

(72) Inventors: Judge W Morgan, Oakboro, NC (US); Daniel Charles Symons, Waxhaw, NC (US); Dyfan Evans, Denbighshire (GB); John David Mouser, Charlotte, NC (US); Darin Kyle Thompson, Huntersville, NC (US)

(73) Assignee: Scott Technologies, Inc., Monroe, NC (US)

( * ) Notice: Subject to any disclaimer, the term of this patent is extended or adjusted under 35 U.S.C. 154(b) by 782 days.

(21) Appl. No.: 14/854,220

(22) Filed: Sep. 15, 2015

(65) Prior Publication Data

US 2016/0001111 A1 Jan. 7, 2016

Related U.S. Application Data

(63) Continuation of application No. PCT/US2014/028017, filed on Mar. 14, 2014.
(Continued)

(51) Int. Cl.
*A62B 18/08* (2006.01)
*A62B 18/02* (2006.01)
(Continued)

(52) U.S. Cl.
CPC ..... *A62B 18/082* (2013.01); *A62B 7/10* (2013.01); *A62B 18/006* (2013.01); *A62B 18/02* (2013.01); *A62B 23/02* (2013.01); *A62B 23/025* (2013.01)

(58) Field of Classification Search
CPC ..... A61M 16/06; A61M 16/009; A61M 16/0093; A61M 16/0087; A61M 16/047;
(Continued)

(56) References Cited

U.S. PATENT DOCUMENTS 4,111,197 A * 9/1978 Warncke ..... A62B 9/04 128/202.27
4,841,953 A * 6/1989 Dodrill ..... A62B 7/04 128/202.27
(Continued)

FOREIGN PATENT DOCUMENTS

SU 886908 12/1981
WO 2005089876 A1 9/2005
(Continued)

*Primary Examiner* — Michael J Tsai

(57) ABSTRACT

Full facemask including a face seal configured to directly engage a face of an individual. The face seal defines a lens opening. The full facemask also includes a mask lens that is coupled to the face seal and disposed within the lens opening. The mask lens has a passage edge that defines a cartridge passage through the mask lens. The full facemask also includes a cartridge module having at least one of a filter or an air regulator. The cartridge module is disposed within the cartridge passage and circumscribed by the passage edge of the mask lens. The full facemask also includes a locking member that includes a first member surface that directly engages the mask lens and a second member surface that directly engages the cartridge module. The locking member secures the mask lens and the cartridge module in fixed positions with respect to each other.

16 Claims, 5 Drawing Sheets

Related U.S. Application Data

(60) Provisional application No. 61/793,383, filed on Mar. 15, 2013.

(51) Int. Cl.

| | |
|---|---|
| ***A62B 23/02*** | (2006.01) |
| ***A62B 7/10*** | (2006.01) |
| ***A62B 18/00*** | (2006.01) |

(58) Field of Classification Search

CPC ..... A61M 16/105; A61M 16/1055; A61M 16/106; A61M 16/1065; A61M 16/107; A61M 16/0605; A61M 16/0611; A61M 16/0622; A61M 16/0627; A61M 2016/0661; A61M 16/0616; A61B 16/06; A62B 7/00; A62B 7/02; A62B 7/04; A62B 7/06; A62B 7/08; A62B 7/10; A62B 7/12; A62B 7/14; A62B 9/04

See application file for complete search history.

(56) References Cited

U.S. PATENT DOCUMENTS

| | | | | |
|---|---|---|---|---|
| 5,803,076 | A | 9/1998 | Myers | |
| 5,924,420 | A * | 7/1999 | Reischel | A62B 18/08 128/206.17 |
| 6,016,804 | A | 1/2000 | Gleason et al. | |
| 2002/0129818 | A1* | 9/2002 | Morgan | A62B 18/08 128/206.26 |
| 2003/0047183 | A1* | 3/2003 | Kiefer | A62B 9/04 128/201.15 |
| 2003/0217752 | A1* | 11/2003 | Muller | A62B 23/02 128/205.27 |
| 2007/0289592 | A1* | 12/2007 | Sutton | A62B 18/02 128/201.24 |
| 2010/0258131 | A1 | 10/2010 | Gaffney et al. | |
| 2011/0100372 | A1 | 5/2011 | Betz et al. | |
| 2012/0160245 | A1* | 6/2012 | Leuschner | A62B 18/08 128/204.26 |
| 2012/0260920 | A1 | 10/2012 | Choi et al. | |
| 2013/0298775 | A1* | 11/2013 | Fiet | A62B 19/00 96/147 |

FOREIGN PATENT DOCUMENTS

| | | |
|---|---|---|
| WO | WO 2011/048162 | 4/2011 |
| WO | 2012150441 A1 | 11/2012 |

* cited by examiner

RECONFIGURABLE FULL FACEMASK HAVING A CARTRIDGE MODULE FOR RESPIRATORY PROTECTION

CROSS-REFERENCE TO RELATED APPLICATIONS

This application is a continuation of International Patent Application No. PCT/US2014/028017 filed Mar. 14, 2014, which claims benefit of U.S. Provisional Patent Application No. 61/793,383, filed Mar. 15, 2013, both of which are incorporated herein by reference.

FIELD OF THE DISCLOSURE

The subject matter described and/or illustrated herein relates generally to face masks that receive a supply of air, and more particularly, to full facemasks that may be used in hazardous environments.

BACKGROUND OF THE DISCLOSURE

An individual who works in a hazardous environment, in which the surrounding air is contaminated or otherwise harmful, may wear respiratory protection equipment that delivers breathing air to the individual. The respiratory protection equipment may include a facemask that covers at least a portion of the face of the wearer. Optionally, the respiratory protection equipment includes a supply of breathing air that delivers fresh breathing air to the facemask. Facemasks include half masks, which may only cover the nose and mouth of the wearer, and full facemasks, which may not only cover the nose and mouth but also the remainder of the face of the wearer. Full facemasks may be worn in environments where exposure to the surrounding air may harm the eyes or skin of the wearer.

Full facemasks typically include a lens (or visor or face shield) and at least one functional component that is located below the lens piece proximate to the mouth of the wearer. The functional components may include at least one of an air regulator, voice emitter, filter, exhalation port, or hydration port. Often, facemasks include more than one functional component. For instance, the facemasks may include two filters located on opposite sides of the facemask and an exhalation port positioned between the two filters. Although full facemasks may have similar fundamental elements (e.g., lens piece and one or more functional components), these fundamental elements may vary greatly based on the intended application of the facemask. For example, firefighters may wear different types of facemasks than the types of facemasks worn by law enforcement during riot control. Each different type of facemask, however, may have a different design.

With respiratory protection equipment, it is often necessary and expensive to undergo fit testing for each facemask variant donned by an individual. During fit testing, the facemask is worn by the individual while certain testing procedures are performed. For example, the fit test may determine whether the facemask is suitably comfortable for certain exercises and whether the facemask has any leaks with respect to the surrounding environment. As noted above, however, facemasks that are used in different applications have different designs. It may be desirable to have a facemask that can be reconfigured without having to re-perform a fit test with the re-configured facemask. In addition to the above, manufacturers often desire simpler and less expensive methods of manufacturing items, including full facemasks.

SUMMARY OF THE DISCLOSURE

In an embodiment, a full facemask to be worn by an individual is provided. The full facemask includes a face seal configured to directly engage a face of the individual. The face seal defines a lens opening. The full facemask also includes a mask lens that is coupled to the face seal and disposed within the lens opening. The mask lens has a passage edge that defines a cartridge passage through the mask lens. The full facemask also includes a cartridge module having at least one of a filter or an air regulator. The cartridge module is disposed within the cartridge passage and circumscribed by the passage edge of the mask lens. The full facemask also includes a locking member that includes a first member surface that directly engages the mask lens and a second member surface that directly engages the cartridge module. The locking member secures the mask lens and the cartridge module in fixed positions with respect to each other.

In certain aspects, the mask lens may entirely surround a periphery of the cartridge module.

In certain aspects, the mask lens may include a flange portion. The cartridge module may be sized and shaped relative to the flange portion such that the flange portion blocks the cartridge module from moving further into the cartridge passage. Optionally, the full facemask may include a gasket positioned between the cartridge module and the flange portion. The gasket may include a compressible material that effectively seals an interior space of the full facemask from the surrounding air.

In certain aspects, the locking member may include a ring portion having the opposite first and second member surfaces. The locking member may be configured to be rotated between first and second orientations. The first member surface may directly engage the mask lens, and the second member surface may directly engage the cartridge module when the locking member is in the second orientation. Optionally, the ring portion and the cartridge module may be shaped relative to each other such that rotating the locking member to the second orientation causes a camming effect that urges the cartridge module into the cartridge passage.

In some embodiments, the locking member may include at least one wing portion that covers a component port of the cartridge module. Optionally, the ring portion may include an opening that aligns with a center component port of the cartridge module.

In certain aspects, the filter or the air regulator is a first functional component. The cartridge module may also include a second functional component. The second functional component may be one of a hydration port, voice emitter, another filter, or exhalation port.

In some embodiments, the cartridge module may include a modular frame that is configured to directly interface with the mask lens. The modular frame may include first and second component ports having first and second functional components disposed therein.

In an embodiment, a reconfigurable full facemask to be worn by an individual is provided. The full facemask includes an outer mask having a face seal configured to directly engage a face of the individual and a mask lens coupled to the face seal. The face seal has a lens opening with the mask lens disposed therein. The outer mask includes a passage edge that defines a cartridge passage through the outer mask. The full facemask also includes a cartridge module having at least one of a filter or an air regulator. The cartridge module is disposed within the cartridge passage and circumscribed by the passage edge of the outer mask. The full facemask also includes quick-release locking member that includes a ring portion having opposite first and second member surfaces. The locking member is configured to be rotated between first and second orientations, wherein the first member surface directly engages the mask lens and the second member surface directly engages the cartridge module when the locking member is in the second orientation. The locking member secures the mask lens and the cartridge module in fixed positions with respect to each other when in the second orientation.

In certain aspects, the mask lens may define the cartridge passage such that the mask lens entirely surrounds a periphery of the cartridge module. Optionally, the mask lens includes a flange portion. The cartridge module may be sized and shaped relative to the flange portion such that the flange portion blocks the cartridge module from moving further into the cartridge passage.

In certain aspects, the ring portion and the cartridge module are shaped relative to each other such that rotating the locking member to the second orientation causes a camming effect that urges the cartridge module into the cartridge passage. Optionally, the locking member may include at least one wing portion that covers a component port of the cartridge module. Optionally, the ring portion may include an opening that aligns with a center component port of the cartridge module.

In certain aspects, the at least one filter or air regulator is a first functional component. The cartridge module may include a second functional component. The second functional component may be one of a hydration port, voice emitter, a filter, or exhalation port.

In certain aspects, the cartridge module is a first cartridge module. The full facemask may also include a second cartridge module that is configured for a different purpose. The first and second cartridge modules having identical peripheries for interfacing with the outer mask.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" or "an exemplary embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Figure 2:
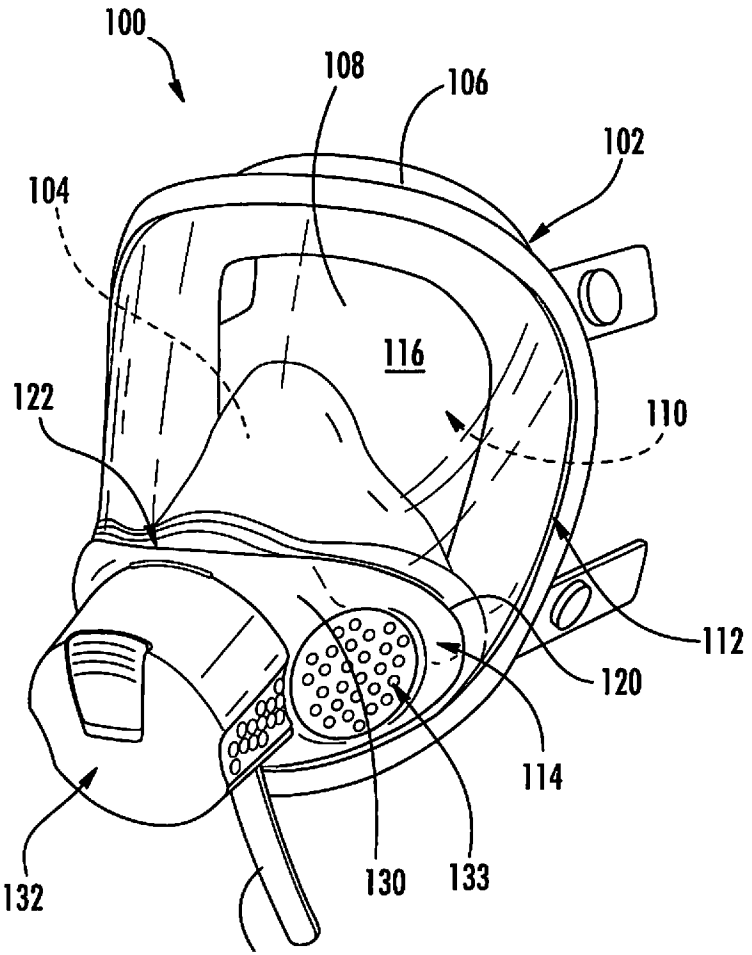
FIG. 2 is another perspective view of the full facemask of FIG. 1.
Figure 1:
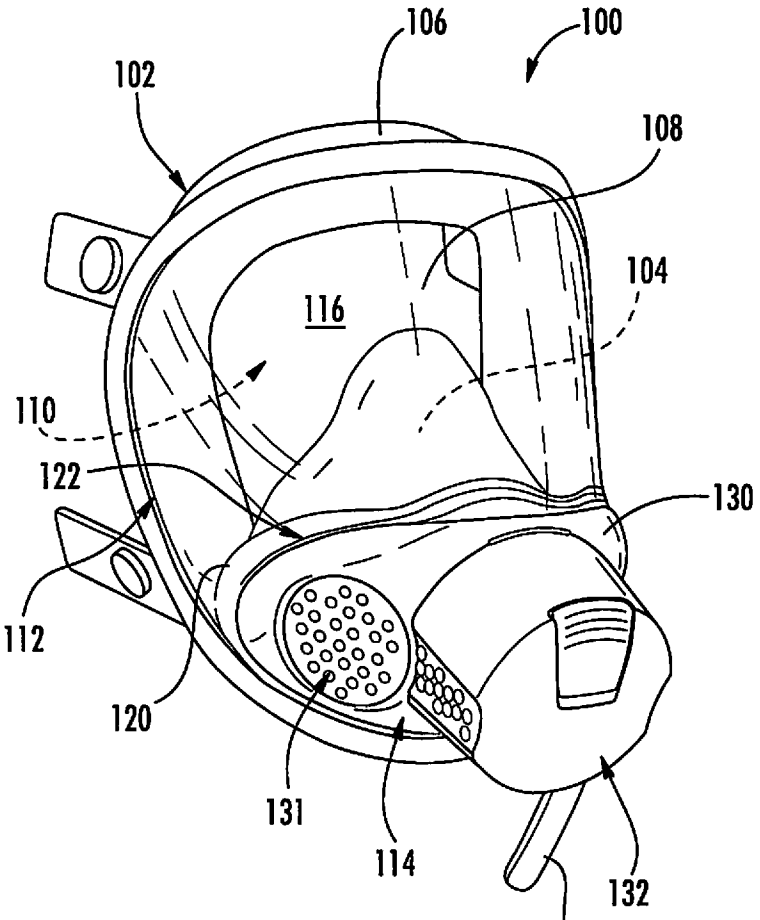
FIG. 1 is a perspective view of a full facemask formed in accordance with one embodiment.

FIGS. 1 and 2 are different perspective views of a full facemask 100 to be worn by an individual (or wearer). FIG. 1 shows the right side (from the viewpoint of the individual) of the full facemask 100, and FIG. 2 shows the left side of the full facemask 100. The full facemask 100 may cover substantially an entire face of the individual. In an exemplary embodiment, the full facemask 100 covers a top of the forehead, a bottom of the chin, and both cheeks of the wearer. The full facemask 100 may be used in various situations in which respiratory protection is desired. The full facemask 100 may be used by emergency personnel (e.g., firefighters, law enforcement, first responders, and the like) or other personnel who work in potentially hazardous environments (e.g., chemical, biological, or nuclear environments). Optionally, the full facemask 100 may be coupled to an air supply (not shown) that supplies fresh breathing air.

The full facemask 100 includes an outer mask 102 and inner mask 104 that are operably coupled to each other. The outer mask 102 may include components that define an exterior of the full facemask 100. For example, the outer mask 102 includes a face seal 106, a mask lens 108, and a cartridge module 114. The mask lens 108 may also be referred to as a visor or face shield. The face seal 106 is configured to directly engage a face of the individual and is directly coupled to the mask lens 108. At least a portion of the face seal 106 may include a compressible material (e.g., rubber, foam, silicone, plastic, and the like) that is pressed against the face of the individual to form a substantially sealed interior space 110 where the eyes, nose, and mouth of the individual are located. The dashed line indicates that the interior space 110 is behind the mask lens 108 in FIGS. 1 and 2. In the illustrated embodiment, the inner mask 104 may constitute a nose cup that provides an oronasal seal. By providing the oronasal seal, exhaled air from the individual is guided out of the facemask 100. The oronasal seal may reduce moisture collecting in the facemask 100.

The mask lens 108 may be coupled to the face seal 106 using one or more methods. For example, the mask lens 108 and the face seal 106 may be joined using at least one of an adhesive, interference fit, fastener (e.g., clip, latch, and the like), or other fastening mechanism. The face seal 106 defines a lens opening or envelope 112 that is configured to provide a substantially full field of view. The mask lens 108 is disposed in the lens opening 112.

The mask lens 108 comprises a transparent material that is configured to protect the individual while also allowing the individual to view the surrounding environment. In an exemplary embodiment, the mask lens 108 is a substantially unitary piece of material (e.g., polycarbonate) having a curved contour. For example, the mask lens may be molded from a single type of material and then coated (e.g., silicone) to protect the mask lens 108 from scratches. The mask lens 108 has a front side 116 and an opposite interior side 118 (shown in FIG. 4). The interior side 118 faces the individual and defines a portion of the interior space 110. The front side 116 defines a portion of the exterior of the full facemask 100. Also shown, the mask lens 108 has a passage edge 120 that defines a cartridge passage or opening 122 through the mask lens 108. The cartridge passage 122 extends between the outer and interior sides 116, 118. As shown, the cartridge module 114 is disposed within the cartridge passage 122 and circumscribed by the passage edge 120.

In the illustrated embodiment, the cartridge module 114 includes a module body 130 that holds functional components 131-133. The functional component 131, 133 are shown in FIGS. 1 and 2, respectively. In the illustrated embodiment, the functional components 131-133 include voice emitters 131, 133 and an air regulator 132. The air regulator 132 is operably coupled to a supply hose 134 that is configured to be in fluid communication with an air supply (not shown). The voice emitters 131, 133 may amplify the voice of the wearer to facilitate communicating with other individuals. The air regulator 132 is configured to receive pressurized air from the air supply and reduce the breathing air. For example, the air regulator 132 may reduce the incoming breathing air to a designated pressure that is suitable for breathing by the wearer. In alternative embodiments, one or more of the functional components 131-133 may include an inhalation valve, hydration port, and a powered air purifying respirator (PAPR) connector for coupling the full facemask 100 to a PAPR (not shown).

In an exemplary embodiment, each of the functional components 131-133 is held in a fixed position with respect to the other functional components by the module body 130 of the cartridge module 114. As such, the functional components 131-133 may be installed and/or removed simultaneously with the other functional components 131-133 when the cartridge module 114 is installed or removed. The full facemask 100 may be characterized as a reconfigurable full facemask such that the cartridge module 114 may be replaced or reconfigured (e.g., by switching filters) by the end user, such as the wearer or other individual associated with the wearer. In an exemplary embodiment, the cartridge module 114 is secured to the outer mask 102 using a locking member 170 (shown in FIG. 5). The locking member 170 may removably couple the outer mask 102 and the cartridge module 114 such that the wearer (or other individual) is capable of quickly removing and positioning a different cartridge module (or the original cartridge module after being reconfigured or inspected) within the cartridge passage 122. As such, the locking member 170 may be referred to as a quick-release locking member.

As used herein, the term "removably coupled" means that a first component (e.g., cartridge module) may be readily separable from a second component (e.g., mask lens or outer mask) without destroying either of the first and second components. Components are readily separable when the two components may be separated from each other without undue effort or a significant amount of time spent in separating the two components. For example, the components may be coupled to one another using fasteners, such as screws, latches, buckles, and the like, where a technician may uncouple the two components using a tool or the technician's hands. In addition, removably coupled components may be coupled without a fastener, such as by forming an interference or snap fit with respect to each other. It is understood that a combination of different methods may be used to removably couple to components. For example, the two components may initially be coupled through an interference fit and then a latch or other fastener may further secure the components together. In an exemplary embodiment, it may take less than five minutes to remove the cartridge module from a fully constructed facemask. In more particular embodiments, it may take less than three minutes. In some embodiments, it may take less than ten minutes to remove the cartridge module and install a new cartridge module such that the facemask is ready to use again.

Figure 3:
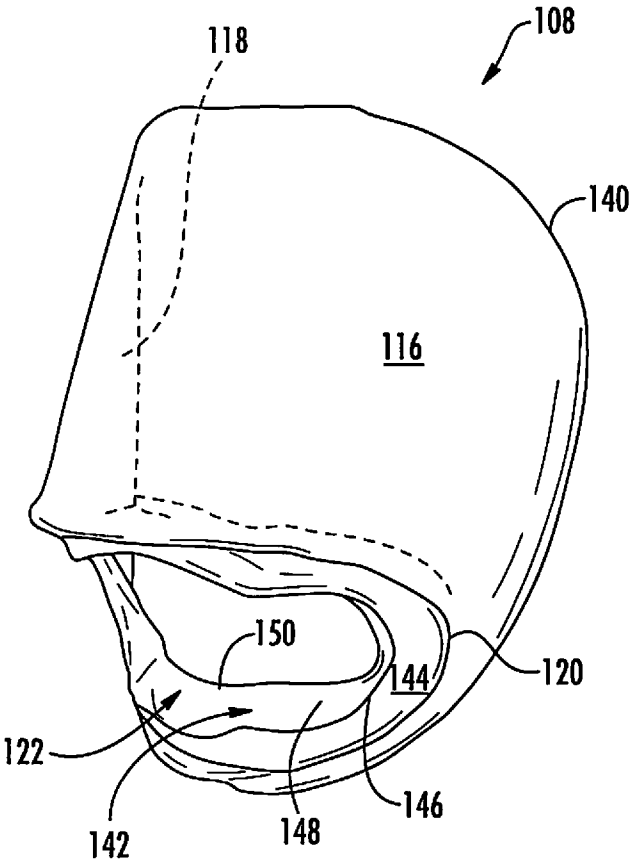
FIG. 3 is an isolated view of a mask lens in accordance with one embodiment that may be used with the full facemask of FIG. 1.

FIG. 3 is an isolated front-perspective view of the mask lens 108 in accordance with one embodiment. As shown, the mask lens 108 includes the front side 116 and the interior side 118. The mask lens 108 has a contour that is configured to generally surround the face of the wearer. A profile of the mask lens 108 is defined by an outer mask edge 140. The outer mask edge 140 is configured to engage the face seal 106 (FIG. 1) when the full facemask 100 (FIG. 1) is fully constructed. For example, the face seal 106 may define a groove or channel that surrounds the outer mask edge 140 and forms an interference fit therewith. In some embodiments, the outer mask edge 140 and a portion of the interior side 118 proximate to the outer mask edge 140 may be secured to the face seal 106 using an adhesive.

The mask lens 108 includes a flange portion 142 that is configured to engage the cartridge module 114 (FIG. 1). The flange portion 142 may define the cartridge passage 122. In the illustrated embodiment, the flange portion 142 includes the passage edge 120, a blocking surface 144, a passage edge 146, and a ledge surface 148. The passage edge 120, the blocking surface 144, the passage edge 146, and the ledge surface 148 may be part of the front side 116, but only the passage edge 120 is exposed when the full facemask 100 is fully constructed.

In the illustrated embodiment, the blocking surface 144 faces in a forward direction that is away from the face of the individual. In alternative embodiments, the blocking surface 144 may face in a rearward direction that is toward the face of the individual. In such embodiments, the blocking surface may form part of the interior side 118. An outer perimeter of the blocking surface 144 shown in FIG. 3 is defined by the passage edge 120 and the passage edge 146. An inner perimeter of the blocking surface 144 is defined by the passage edge 146. To distinguish the passage edges 120, 146, the passage edges 120, 146 may be referred to as the outer and inner passage edges 120, 146. Each of the passage edges 120, 146 defines the cartridge passage 122. For example, each of the passage edges 120, 146 define different portions of the cartridge passage 122. The ledge surface 148 may face substantially radially inward. As shown, the flange portion 142 also includes an interior edge 150. The interior edge 150 may be part of the interior side 118. The flange portion 142 is shaped to receive and engage the cartridge module 114 (FIG. 1). More specifically, one or more of the interior edge 150, the ledge surface 148, the inner passage edge 146, the blocking surface 144, and the outer passage edge 120 may be shaped relative to the shape of the cartridge module 114 to facilitate holding the cartridge module 114 in a designated position.

Figure 4:
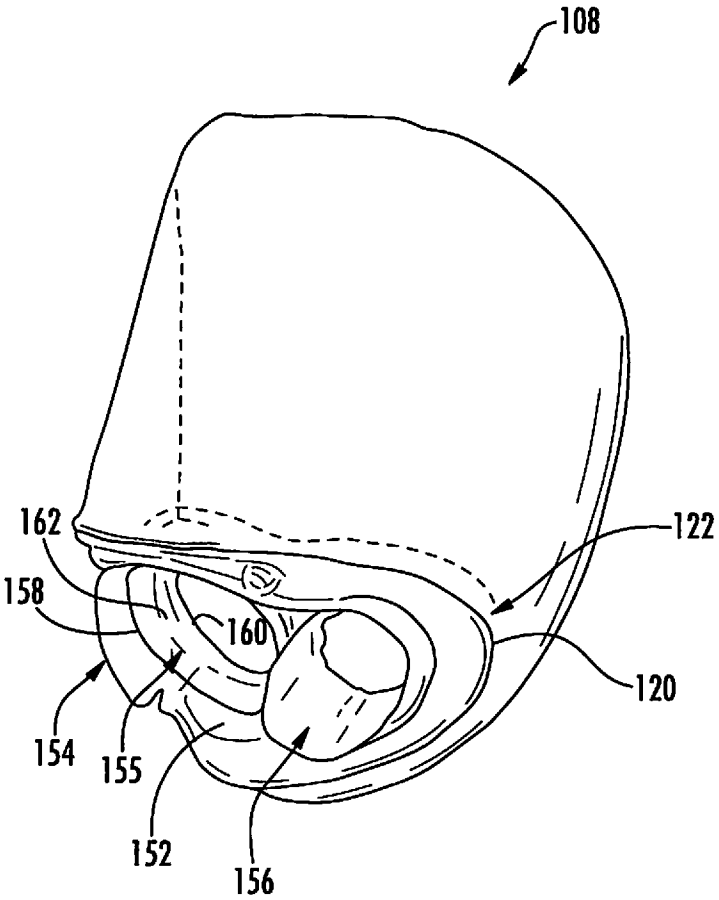
FIG. 4 is an isolated view of the mask lens having a modular frame positioned within a cartridge passage of the mask lens.

FIG. 4 is an isolated view of the mask lens 108 having a modular frame 152 coupled thereto. The cartridge module 114 (FIG. 1) may include the modular frame 152. More specifically, the modular frame 152 may be one element of the cartridge module 114. In some embodiments, the modular frame 152 may constitute or form a part of the module body 130 (FIG. 1). The modular frame 152 is configured to directly engage the mask lens 108. More specifically, the modular frame 152 may be shaped to complement the shape of the flange portion 142 (FIG. 4). The module frame 152 may directly engage at least one of the interior edge 150

(FIG. 4), the ledge surface 148 (FIG. 4), the inner passage edge 146 (FIG. 4), the blocking surface 144 (FIG. 4), and the outer passage edge 120.

In the illustrated embodiment, the module frame 152 includes first, second, and third component ports 154-156. Each of the first, second, and third component ports 154-156 is defined by an exterior port edge 158, an interior port edge 160, and an inward facing surface 162 that extends between the corresponding exterior and interior port edges 158, 160. Each of the first, second, and third component ports 154-156 is sized and shaped to receive a corresponding functional component. In some embodiments, each of the first, second, and third component ports 154-156 may have a common (i.e., the same) size and shape. In other embodiments, only the first and third component ports 154, 156 have the same size and shape. Yet in other embodiments, the first, second, and third component ports 154-156 have different sizes and/or shapes.

In FIG. 4, the modular frame 152 is disposed within the cartridge passage 122 of the mask lens 108 without the remaining components of the cartridge module 114. In other embodiments, the cartridge module 114 may be fully assembled prior to positioning the cartridge module 114 within the cartridge passage 122. As such, each of the functional components 131-133 (FIG. 1) may be positioned within the cartridge passage 122 and secured to the mask lens 108 at the same time.

As shown in FIG. 4, the mask lens 108 circumscribes the modular frame 152 (or cartridge module 114). More specifically, the material of the mask lens 108 entirely surrounds the modular frame 152 such that the modular frame 152 does not engage the face seal 106 or other portions of the outer mask 102 along a periphery of the modular frame 152. In alternative embodiments, the mask lens 108 does not entirely surround the modular frame 152. In some embodiments, a gasket, such as the gasket 210 shown in FIG. 8, may be positioned along the flange portion 142 to further seal the cartridge module 114 when the cartridge module 114 is positioned within the cartridge passage 122. More specifically, the gasket may be positioned to extend along at least one of the blocking surface 144 (FIG. 4) or the ledge surface 148 (FIG. 4). The gasket may exist between opposing surfaces of the mask lens 108 and the modular frame 152 (or cartridge module 114) and fill gaps therebetween to effectively seal the interior space 110 (FIG. 1) from the surrounding environment.

Figure 6:
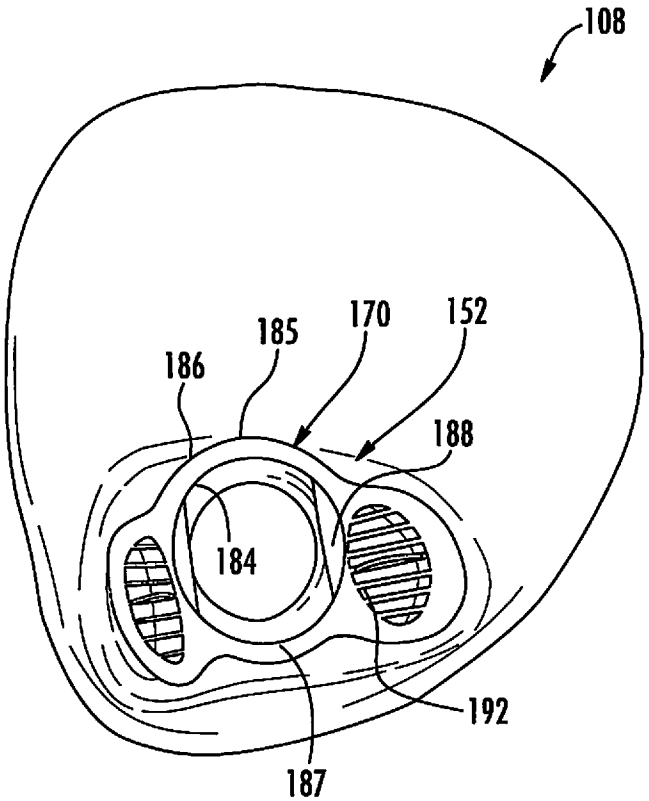
FIG. 6 is a rear perspective view of the mask lens and the modular frame when the locking mechanism is shown in a locked position.
Figure 5:
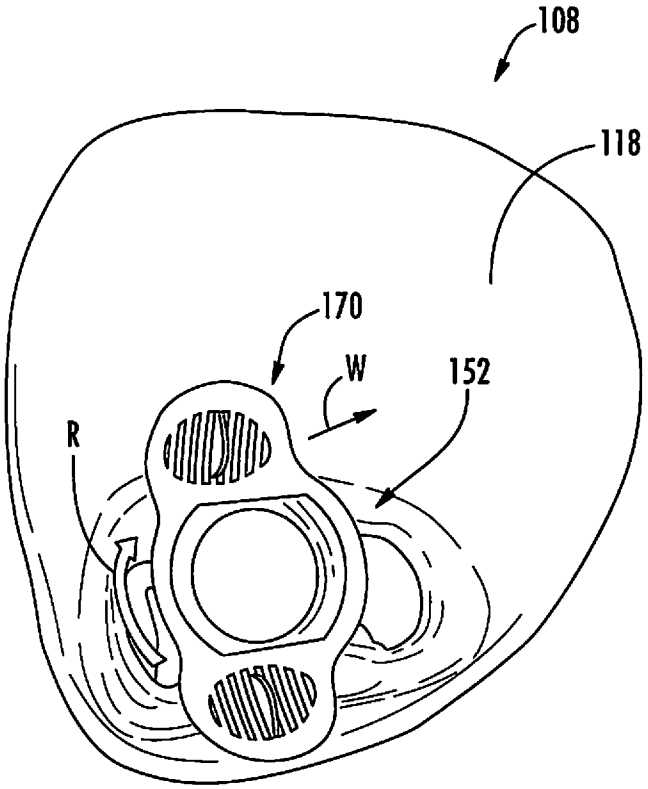
FIG. 5 is a rear perspective view of the mask lens and the modular frame illustrating a locking mechanism for securing the mask lens and the modular frame together.

FIGS. 5 and 6 are rear perspective views of the mask lens 108 and the modular frame 152 coupled together with a locking member 170 operably coupled thereto. FIG. 5 shows the locking member 170 in a first orientation in which the mask lens 108 and the modular frame 152 are not secured to each other. In the first orientation, the locking member 170 may be freely removed in a withdrawing direction W away from the interior side 118. FIG. 6 shows the locking member 170 in a second orientation in which the mask lens 108 and the modular frame 152 are secured to each other. To secure the mask lens 108 and the modular frame 152, the locking member 170 is rotated in a clockwise manner as indicated by the arrow R from the first orientation to the second orientation. In the second orientation, the mask lens 108 and the modular frame 152 are secured in fixed positions with respect to each other and the locking member W may not be freely removed in the withdrawing direction W.

Figure 7:
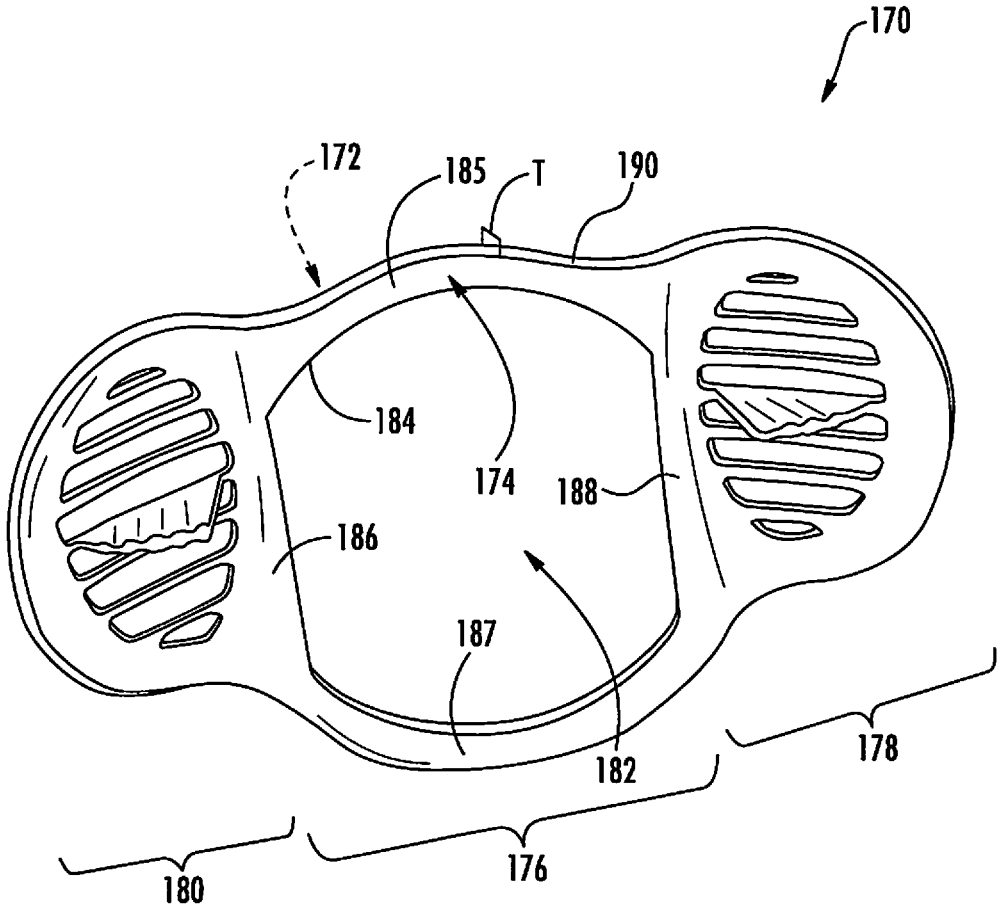
FIG. 7 is an isolated view of a locking member that may be used with the locking mechanism.

FIG. 7 is an isolated view of the locking member 170 in accordance with an embodiment. The locking member 170 may be referred to as a locking ring. The locking member 170 includes first and second member surfaces 172, 174 that face in opposite directions. A thickness T of the locking member 170 extends between the first and second member surfaces 172, 174. The first member surface 172 is configured to face away from the individual and the second member surface 174 is configured to face toward the individual. The locking member 170 includes a ring portion 176 and first and second wing (or flap) portions 178, 180 on opposite sides of the ring portion 176. The ring portion 176 includes an opening or passage 182. When the locking member 170 is installed and has the second orientation as shown in FIG. 6, the opening 182 of the ring portion 176 is aligned with the second component port 155 (FIG. 4), the first wing portion 178 covers the first component port 154 (FIG. 4), and the second wing portion 180 covers the third component port 156 (FIG. 4).

The ring portion 176 may include an inner ring edge 184 that extends along first and second bridge members 185, 187 and first and second grip members 186, 188. The first and second bridge members 185, 187 extend generally parallel to each other, and the first and second grip members 186, 188 extend generally parallel to each other. The inner ring edge 184 along the first and second grip members 186, 188 may be substantially linear. The inner ring edge 184 may define the opening 182. The first and second bridge members 185, 187 extend across and join the first and second wing portions 178, 180. As shown, the locking member 170 may also includes an outer member edge 190 that extends along the first and second bridge members 185, 187.

The inner ring edge 184 and the outer member edge 190 may be sized and shaped such that the locking member 170 engages each of the cartridge module 114 (FIG. 1) and the mask lens 108 (FIG. 1) as the locking member 170 is rotated from the first orientation (FIG. 5) to the second orientation (FIG. 6). For example, as shown in FIG. 6, the inner ring edge 184 along the first and second grip members 186, 188 is positioned underneath a member flange 192 of the modular frame 152 (or cartridge module 114). The first member surface 172 (FIG. 7) along at least one of the first and second bridge members 185, 187 may directly engage the mask lens 108 when the locking member 170 is in the second orientation.

In an exemplary embodiment, the locking member 170, the mask lens 108, and the cartridge module 114 are shaped relative to each other such that rotating the locking member 170 from the first orientation to the second orientation causes a camming effect that urges the cartridge module 114 further into the cartridge passage 122. More specifically, the first member surface 172 is shaped relative to a surface of the interior side 118 of the mask lens 108 and the second member surface 174 is shaped relative to a surface of an underside of the member flange 192. As the locking member 170 is rotated, the interaction between the first member surface 172 and the surface of the mask lens 108 and between the second member surface 174 and the underside of the member flange 192 (in other words, the camming effect) drives the mask lens 108 and the cartridge module 114 closer to each other. The camming effect may further compress the gasket positioned between the cartridge module 114 and the mask lens 108. As such, in the second orientation, the first surface 172 is pressed against the mask lens 108 and the second surface 172 is pressed against a surface of the member flange 192. Accordingly, the locking member 170 generates forces in opposite directions to secure the cartridge module 114 to the mask lens 108.

In the illustrated embodiment, the locking member 170 is a locking ring that is rotatable about an axis of rotation. However, a variety of locking members having member surfaces may be used in other embodiments to removably couple and secure the mask lens 108 and the cartridge module 114 to each other in fixed positions. For example, the locking member may be hardware, such as screws. Different member surfaces of the screws (e.g., different thread surfaces) may directly engage the mask lens and the cartridge module. The locking member may also include a clip, a clasp, buckle, or a latch. For instance, a member surface of a latch may be secured to the cartridge module. Once the cartridge module is inserted into the cartridge passage of the mask lens, the latch may be activated to engage the mask lens thereby removably securing the mask lens and the cartridge module to each other. In alternative embodiments, the mask lens 108 and the cartridge module 114 may be bonded to each other using an adhesive. In alternative embodiments, the mask lens 108 and the cartridge module 114 may form a snap-fit (e.g., interference fit) such that a locking member is not required.

Figure 8:
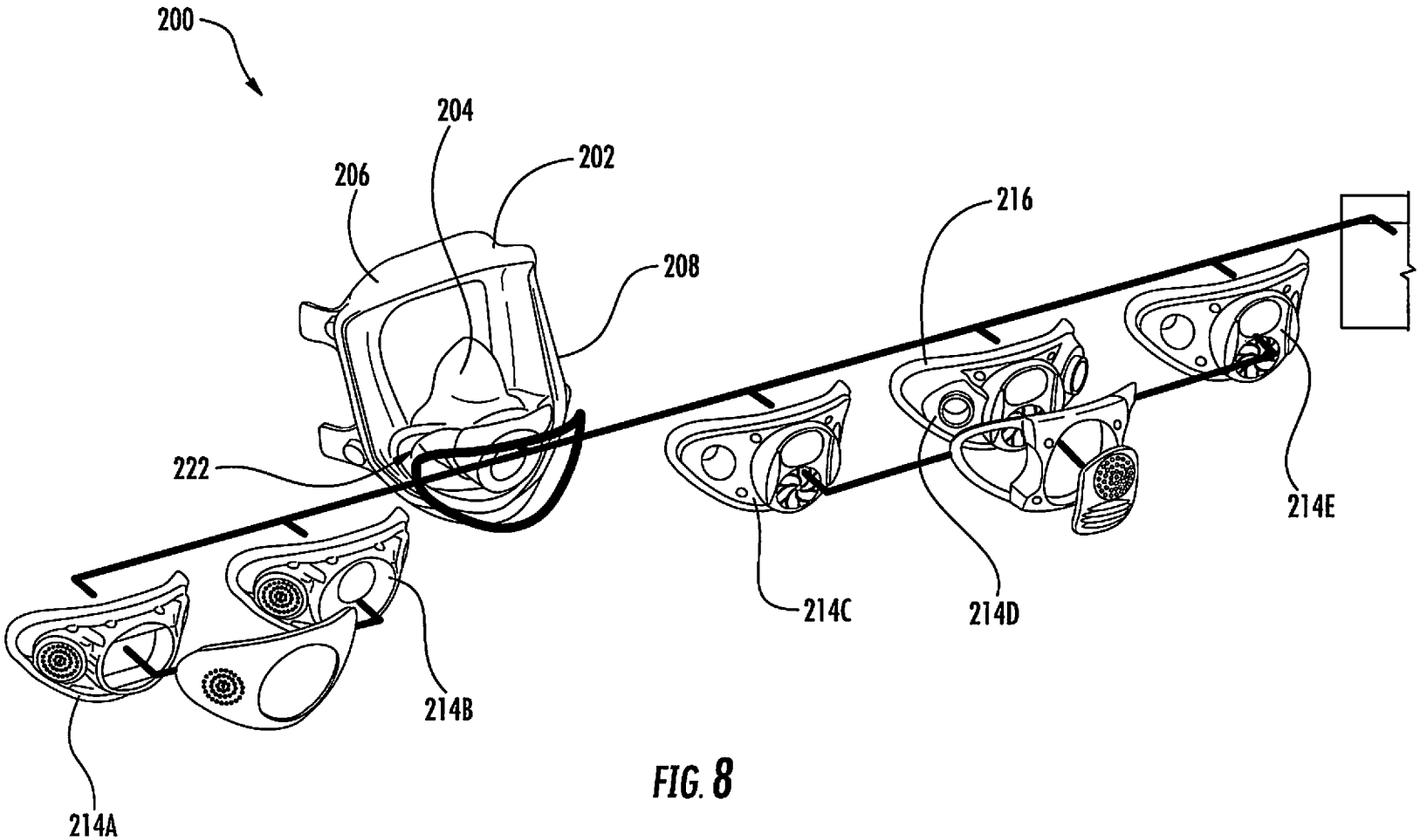
FIG. 8 illustrates a reconfigurable full facemask in accordance with an embodiment.

FIG. 8 illustrates a reconfigurable full facemask 200 in accordance with an embodiment. The full facemask 200 may be similar or identical to the full facemask 100 (FIG. 1). For example, the full facemask 200 includes an outer mask 202 and inner mask 204 that are operably coupled to each other. The outer mask 202 may include a face seal 206 and a mask lens 208. During operation, the outer mask 202 also includes one of the cartridge modules 214A-214E. As shown, the full facemask 200 may include a cartridge passage or opening 222. The cartridge passage 222 may be defined by the outer mask 202 and/or the mask lens 208. A gasket 210 may be disposed within the cartridge passage 222.

Each of the cartridge modules 214A-214E is sized and shaped to be positioned within the cartridge passage 222. The gasket 210 may be positioned between a surface that defines the cartridge passage 222 and a surface of the corresponding cartridge module. As shown, the cartridge modules 214A-214E have effectively identical peripheries 216. Peripheries from different cartridge modules may be effectively identical if the different peripheries are capable of being positioned, separately, within the same cartridge passage and engage the outer mask in a manner that sufficiently seals an interior space of the full facemask from the surrounding air. For example, the cartridge modules 214A-214E have effectively identical peripheries 216 such that each of the cartridge modules 214A-214E is capable of being positioned within the cartridge passage and sealing the interior space of the full facemask from the surrounding environment. For example, as seen in FIG. 8 the cartridge module 214A-214E may include configurations such as an air supplied configuration, e.g., positive pressure mode, where air may be supplied from a pressure source such as from a Self-Contained Breathing Apparatus (SCBA) 214A or Powered Air Purifying Respirator (PAPR) or combined SCBA/PAPR 214B, or in an air purifying configuration, e.g., negative pressure mode, where air may be drawn through filtering media, e.g., a filter is attached to mask and user breaths in drawing air through the filter(s) 214C, a PAPR is attached to a mask with filter(s) 214D and the user pulls/breaths air in through PAPR/filter(s) 214E.

In accordance with one or more embodiments described herein, a full facemask is provided that affords, among other technical effects, the technical effect of permitting a wearer to quickly remove a cartridge module and replace the cartridge module with a different cartridge module or a re-configured original cartridge module. One or more embodiments may also enable a manufacturer to use a common mask lens to construct different full facemasks that are configured for different purposes. A technical effect may also include a quick-release mechanism that removably couples a mask lens and a cartridge module.

Additional technical effects may include modular full facemasks having a mask lens piece that forms a cartridge passage or envelope along a lower half of the mask lens. Multiple variations of cartridge modules may be individually secured in the cartridge passage based on the desired application. As such, the modular full facemask may enable a user to upgrade/reconfigure the full facemask to meet changing needs as desired. This may also simplify an assembly process to adjust the functional components based on the desired usage of the facemask. Another technical effect may include the ability to adapt the facemask for use in as many situations as possible while requiring the user to only fit test with one facemask. Functional changes (i.e., switching the cartridge modules) may not require the wearer to change the face seal to meet the needs of a different task. Accordingly, embodiments include functional components that are fixable within a cartridge passage and can be changed by the wearer as necessary or desirable. For example, the full facemask can be changed from a dedicated APR mask that incorporates very low profile filters for tactical situations to an SCBA mask that accepts an SCBA regulator and back as necessary to suit the user's needs of both a low profile gas mask and an SCBA. The cartridge modules may include user hydration devices for operations when users wear PPE for extended periods or a combination of respirators that provide the user the ability to switch back and forth between SCBA and PAPR or APR modes.

While various spatial and directional terms, such as top, bottom, front, back lower, mid, lateral, horizontal, vertical, and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision other modifications within the scope and spirit of the claims appended hereto.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions, types of materials and coatings described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112(f) unless and until such claim limitations expressly use the phrase "means for" followed by a statement of function void of further structure.

What is claimed is:

1. A full facemask to be worn by an individual, the full facemask comprising:

a face seal configured to directly engage a face of the individual, the face seal defining a lens opening;

a mask lens coupled to the face seal and disposed within the lens opening, the mask lens having a passage edge that defines a cartridge passage through the mask lens, an interior side, and a front side opposite the interior side, the interior side of the mask lens at least partially defining an interior space of the full facemask;

a cartridge module including at least one of a filter and an air regulator, the cartridge module being disposed within the cartridge passage and circumscribed by the passage edge of the mask lens, the cartridge module further including a modular frame having a first component port, a second component port, a third component port, and a member flange adjacent the second component port, the member flange located at least partially within the interior space of the full facemask, the second component port being between the first and third component ports; and a locking member within the interior space of the full facemask, the locking member including a first member surface that is in direct contact with the mask lens and a second member surface that is in direct contact with the cartridge module, the locking member being rotatable between a first orientation and a second orientation, the locking member further including:

an annular ring portion having an opening, a first bridge member, a second bridge member opposite the first bridge member, a first grip member, and a second grip member opposite the first grip member, the first and second grip members being parallel to each other;

a first wing portion on a first side of the annular ring portion proximate the first grip member and having at least one first aperture; and a second wing portion on a second side of the annular ring portion opposite the first side of the annular ring portion and proximate the second grip member, the second wing portion having at least one second aperture, the annular ring portion further having a third aperture that is aligned with and rotatable about the second component port when the locking member is in the first orientation and the second orientation, the first and second bridge members and the first and second grip members together defining the third aperture, the at least one first aperture of the first wing portion being aligned with the first component port and the at least one second aperture of the second wing portion being aligned with the third component port when the locking member is in the second orientation;

the first and second grip members not being positioned between the member flange of the modular frame, and the locking member is freely removed away from the interior side of the mask lens when the locking member is in the first orientation; and each of the first and second grip members being positioned between an underside of the member flange of the modular frame and the interior side of the mask lens such that the locking member secures the modular frame and the mask lens in fixed positions with respect to each other when the locking member is in the second orientation.

2. The full facemask of claim 1, wherein the mask lens entirely surrounds a periphery of the cartridge module.

3. The full facemask of claim 1, wherein the mask lens includes a flange portion, the cartridge module being sized and shaped relative to the flange portion such that the flange portion blocks the cartridge module from moving further into the cartridge passage.

4. The full facemask of claim 3, further comprising a gasket positioned between the cartridge module and the flange portion, the gasket comprising a compressible material that effectively seals an interior space of the full facemask from the surrounding air.

5. The full facemask of claim 1, wherein the modular frame is removably couplable to the mask lens, the annular ring portion of the locking member having the opposite first and second member surfaces, the first member surface being in direct contact with the interior side of the mask lens and the second member surface being in direct contact with the underside of the member flange of the modular frame of the cartridge module when the locking member is in the second orientation.

6. The full facemask of claim 5, wherein the annular ring portion and the cartridge module are shaped relative to each other such that rotating the locking member to the second orientation causes a camming effect that urges the cartridge module into the cartridge passage.

7. The full facemask of claim 1, wherein the at least one of the filter and the air regulator is a first functional component, the cartridge module further comprising a second functional component, the second functional component being one of a hydration port, voice emitter, another filter, or exhalation port.

8. The full facemask of claim 7, wherein the modular frame is configured to directly interface with the mask lens, the modular frame including the first and the second functional components being disposed within the first and the second component ports.

9. A reconfigurable full facemask to be worn by an individual, the reconfigurable full facemask comprising:

an outer mask comprising a face seal configured to directly engage a face of the individual and a mask lens coupled to the face seal, the face seal having a lens opening with the mask lens disposed therein, the outer mask including a passage edge that defines a cartridge passage through the outer mask, the mask lens including an interior side and a front side opposite the interior side;

a cartridge module including at least one of a filter and an air regulator, the cartridge module being disposed within the cartridge passage and circumscribed by the passage edge of the outer mask, the cartridge module including a modular frame defining a component port and a member flange that at least partially circumscribes the component port, at least a portion of the cartridge module being on the front side of the mask lens and at least a portion of the member flange extending into the interior side of the mask lens; and a quick-release locking member positioned on the interior side of the mask lens and comprising a ring portion having opposite first and second member surfaces, the ring portion including an opening defined by an inner ring edge, the inner ring edge having a first grip portion extending into the opening and a second grip portion extending into the opening and being opposite and extending parallel to the first grip portion, the quick-release locking member configured to be rotated on the interior side of the mask lens between first and second orientations about an axis of rotation that extends through the ring portion of the quick-release locking member, the first member surface being in direct contact with the mask lens and the second member surface being in direct contact with the cartridge module when the quick-release locking member is in the second orientation such that at least a portion of each of the first grip portion and the second grip portion is positioned under the member flange defined by the modular frame of the cartridge module, thereby securing the cartridge module within the cartridge passage of the mask lens.

10. The reconfigurable full facemask of claim 9, wherein the mask lens defines the cartridge passage such that the mask lens entirely surrounds a periphery of the cartridge module.

11. The reconfigurable full facemask of claim 10, wherein the mask lens includes a flange portion, the cartridge module being sized and shaped relative to the flange portion such that the flange portion blocks the cartridge module from moving further into the cartridge passage.

12. The reconfigurable full facemask of claim 9, wherein the ring portion and the cartridge module are shaped relative to each other such that rotating the quick-release locking member to the second orientation causes a camming effect that urges the cartridge module into the cartridge passage and toward the interior side of the mask lens.

13. The reconfigurable full facemask of claim 12, wherein the ring portion includes an opening that aligns with a center component port of the cartridge module when the quick-release locking member is in either the first orientation or the second orientation.

14. The reconfigurable full facemask of claim 9, wherein the modular frame has a first component port, a second component port, and a third component port, the component port being the second component port, the second component port being between the first and third component ports, the quick-release locking member including a first wing portion that includes at least one first aperture and a second wing portion that includes at least one second aperture, the at least one first aperture of the first wing portion being aligned with the first component port of the cartridge module and the at least one second aperture of the second wing portion being aligned with the third component port of the cartridge module when the quick-release locking member is in the second orientation.

15. The reconfigurable full facemask of claim 9, wherein the at least one of the filter and the air regulator is a first functional component, the cartridge module further comprising a second functional component, the second functional component being one of a hydration port, voice emitter, a filter, or exhalation port.

16. The reconfigurable full facemask of claim 9, wherein the cartridge module is a first cartridge module, the reconfigurable full facemask further comprising a second cartridge module that is configured for a different purpose, the first and second cartridge modules having identical peripheries for interfacing with the outer mask.

* * * * *